US012116733B2

(12) United States Patent
Widlroither

(10) Patent No.: US 12,116,733 B2
(45) Date of Patent: Oct. 15, 2024

(54) VIBRATORY TAMPING MACHINE FOR COMPACTING A BALLAST BED OF A TRACK

(71) Applicant: ROBEL Bahnbaumaschinen GmbH, Freilassing (DE)

(72) Inventor: Otto Widlroither, Freilassing (DE)

(73) Assignee: ROBEL BAHNBAUMASCHINEN GMBH, Freilassing (DE)

( * ) Notice: Subject to any disclaimer, the term of this patent is extended or adjusted under 35 U.S.C. 154(b) by 797 days.

(21) Appl. No.: 15/734,520

(22) PCT Filed: Jul. 25, 2018

(86) PCT No.: PCT/EP2018/070125
§ 371 (c)(1),
(2) Date: Dec. 2, 2020

(87) PCT Pub. No.: WO2020/020448
PCT Pub. Date: Jan. 30, 2020

(65) Prior Publication Data

US 2021/0230810 A1 Jul. 29, 2021

(51) Int. Cl.
*E01B 27/20* (2006.01)

(52) U.S. Cl.
CPC ..... *E01B 27/20* (2013.01); *E01B 2203/127* (2013.01)

(58) Field of Classification Search
CPC ..... E01B 27/20; E01B 27/14; E01B 2203/127
See application file for complete search history.

(56) References Cited

U.S. PATENT DOCUMENTS 2,643,649 A * 6/1953 Tarwater ..... B25D 11/102 74/56
3,042,386 A * 7/1962 Wyzenbeek ..... E04G 21/08 366/122
10,494,769 B2 * 12/2019 Widlroither ..... E01B 27/14
2006/0113098 A1 * 6/2006 Inagawa ..... B24B 23/028 173/162.2
2008/0196913 A1 * 8/2008 Bram ..... B25D 17/043 173/162.2
2013/0263755 A1 * 10/2013 Widlroither ..... E01B 27/14 104/13
2013/0269563 A1 * 10/2013 Widlroither ..... E01B 27/20 104/13
2014/0224146 A1 * 8/2014 Widlroither ..... E01B 1/001 104/13

(Continued)

FOREIGN PATENT DOCUMENTS

CN 2608542 Y 3/2004
CN 2690448 Y 4/2005

(Continued)

*Primary Examiner* — Scott A Browne
(74) *Attorney, Agent, or Firm* — McGlew and Tuttle, P.C.

(57) ABSTRACT

A vibratory tamping machine for compacting a ballast bed of a track has a vibration mechanism which is driven by means of an electric drive motor. The vibratory tamping machine has a vibration decoupling device, which defines a decoupling plane and separates a working side from an operating side, for the vibration-decoupling of at least one handle. The handles are arranged on the operating side, whereas the electric drive motor and the vibration mechanism are arranged on the working side.

20 Claims, 3 Drawing Sheets

(56) References Cited

U.S. PATENT DOCUMENTS

2020/0141064 A1* 5/2020 Benjamin ..... E01B 29/26

FOREIGN PATENT DOCUMENTS

| | | | | |
|---|---|---|---|---|
| CN | 2878460 | Y | 3/2007 | |
| CN | 206143544 | U | 5/2017 | |
| FR | 1385159 | A | 1/1965 | |
| JP | S54-83210 | A | 7/1979 | |
| WO | 2012139687 | A1 | 10/2012 | |
| WO | WO-2019243756 | A1 * | 12/2019 | ..... B23D 45/003 |

* cited by examiner

VIBRATORY TAMPING MACHINE FOR COMPACTING A BALLAST BED OF A TRACK

FIELD OF THE INVENTION

The invention relates to a vibratory tamping machine for compacting a ballast bed of a track having a vibration mechanism, an electric drive motor for driving the vibration mechanism, at least one handle for holding the vibratory tamping machine and a vibration decoupling device for the vibration-decoupling of the at least one handle and the vibration mechanism.

BACKGROUND OF THE INVENTION

Disclosed in WO 2012/139687 A1 is an electrically operated vibratory tamping machine which has a vibration decoupling device between handles for manually holding the vibratory tamping machine and a rotating unbalance shaft with an unbalance arranged thereon. The transmission to the handles of the vibrations which are required for compacting the ballast bed and/or the ballast may be substantially reduced by the vibration decoupling device.

SUMMARY OF THE INVENTION

An object of the invention is to provide a vibratory tamping machine which is of simple construction, which is reliable and which has improved ease of operation.

This object is achieved by a vibratory tamping machine, in which the vibration mechanism and the electric drive motor are arranged on a working side of a decoupling plane formed by the vibration decoupling device. The vibration decoupling device defines the decoupling plane which separates a working side from an operating side. The term decoupling plane is to be understood functionally, such that by the vibration decoupling device the operating side is vibration-decoupled from the working side and/or the operating side is vibration-damped relative to the working side. The term decoupling plane is not to be understood strictly as a plane in geometric terms. The at least one handle for holding the vibratory tamping machine is arranged on the operating side. Accordingly, the vibration mechanism and the electric drive motor are arranged on the working side. As the vibration mechanism and the electric drive motor are arranged together on the working side, both the forces and/or vibrations generated by the electric drive motor and by the vibration mechanism are decoupled and/or damped by means of the vibration decoupling device, so that these forces and/or vibrations only act in a significantly damped manner on the at least one handle. As the electric drive motor is arranged on the working side, the mechanical connection to the vibration mechanism is configured in a simple and reliable manner. It is not necessary to guide a mechanical drive shaft through the decoupling plane and to decouple and/or to damp vibrations transmitted via the mechanical drive shaft. As no mechanical connection for driving the vibration mechanism leads through the decoupling plane, the hand-arm vibrations for an operator may be reduced and the ease of operation increased. Additionally, the at least one handle may vibrate undisturbed at its natural frequency, whereby the hand-arm vibrations are reduced. The vibration decoupling device is configured, in particular, such that hand-arm vibrations for an operator do not exceed a limit value of 5 $m/s^2$. By the absence of a mechanical connection through the decoupling plane, the vibratory tamping machine is constructed in a simpler and more reliable manner since components which are prone to failure are dispensed with.

The electric drive motor and/or vibration mechanism are preferably arranged in a tube. The tube is also denoted as a tamping pick tube. The vibration mechanism is arranged, in particular, in a lower portion of the tamping pick tube. The tamping pick tube is preferably connected to the vibration decoupling device. The electric drive motor is arranged, in particular, in the tamping pick tube between the vibration mechanism and the vibration decoupling device. The vibration mechanism comprises, in particular, an unbalance which is exclusively displaceable radially to a rotational axis of the drive motor in order to produce an oscillation and/or vibration.

When operated by an operator the vibratory tamping machine is held manually and is thus hand-held. The at least one handle serves, in particular, for the two-handed holding of the vibratory tamping machine. The vibratory tamping machine is also denoted as a vibratory tamper and/or manual tamper.

A vibratory tamping machine, in which the vibration decoupling device comprises at least one vibration damper for forming the decoupling plane between the vibration mechanism and the at least one handle, ensures significant ease of operation. The at least one vibration damper is resiliently configured so that vibration-decoupling and/or vibration-damping is achieved. Preferably, the at least one vibration damper comprises an elastomer material, in particular a rubber material. The vibration decoupling device has, in particular at least two, in particular at least three, and in particular at least four, vibration dampers. The vibration dampers are preferably arranged about a rotational axis of the electric drive motor. The decoupling plane is formed and/or defined by the at least one vibration damper.

A vibratory tamping machine, in which a rechargeable battery for supplying the electric drive motor with electric power is arranged on an operating side of the decoupling plane, ensures in a simple manner significant ease of operation. As the rechargeable battery is arranged on the operating side, it forms a counterweight for the vibration mechanism and the electric drive motor, so that the rechargeable battery performs an effective vibration-damping and/or vibration-decoupling on the at least one handle. The rechargeable battery is additionally protected from vibrations of the vibration mechanism and the electric drive motor. The rechargeable battery is preferably fastened to a support frame, in turn at least one handle and/or the vibration decoupling device being fastened thereto.

A vibratory tamping machine, in which the rechargeable battery is replaceably fastened to a support frame and is connected to a handle, ensures in a simple manner significant ease of operation. As the rechargeable battery is replaceably fastened to the support frame, during operation of the vibratory tamping machine a discharged rechargeable battery may be rapidly and easily replaced by a charged rechargeable battery and the operation of the vibratory tamping machine may be continued. The handle connected to the rechargeable battery serves, on the one hand, for changing the rechargeable battery and, on the other hand, for holding the vibratory tamping machine during operation. As the rechargeable battery and the handle fastened thereto are arranged on the operating side, the handle fastened to the rechargeable battery is also vibration-decoupled and/or vibration-damped.

A vibratory tamping machine, in which a control device is arranged on an operating side of the decoupling plane, ensures a high level of reliability and significant ease of operation. As the control device is arranged on the operating side, it is protected from undamped forces and/or vibrations of the vibration mechanism and the electric drive motor, whereby the reliability of the vibratory tamping machine is high. The control device comprises, in particular, at least one operating element for activating the electric drive motor, which is fastened in a simple manner on the vibration-decoupled and/or vibration-damped operating side in the vicinity of the at least one handle and/or on the at least one handle.

A vibratory tamping machine, in which exclusively lines run through the decoupling plane, ensures in a simple manner significant ease of operation. As exclusively lines run through the decoupling plane, i.e. no mechanical connection for driving the vibration mechanism runs through the decoupling plane, an optimal vibration-decoupling and/or vibration-damping is permitted. The lines are configured, in particular, in a flexible manner. The lines are electrical lines for activating and supplying power to the electric drive motor and optionally a cooling device, as well as optionally at least one coolant line. As the rechargeable battery on the operating side and the electric drive motor together with the vibration mechanism are arranged on the working side, it is sufficient that exclusively electrical lines for activating and for supplying power and optionally at least one coolant line run through the decoupling plane. The lines transmit substantially no forces and/or vibrations from the working side to the operating side.

A vibratory tamping machine, in which a cooling device for cooling the electric drive motor and/or the vibration mechanism, ensures a high level of reliability. During the operation of the vibratory tamping machine, heat generated by the electric drive motor and/or the vibration mechanism may be easily dissipated by means of the cooling device, so that the electric drive motor and/or the vibration mechanism may be sufficiently cooled.

The cooling device is arranged on the operating side and/or on the working side so that for operating the cooling device exclusively at least one electrical line and/or at least one coolant line run through the decoupling plane. The cooling device is, for example, a fan which may be electrically operated and which uses air as coolant. Furthermore, the cooling device comprises, for example, a pump and a cooler for conveying and cooling a liquid as coolant.

A vibratory tamping machine, in which the electric drive motor is arranged in an upper portion of a tube facing the decoupling plane, ensures in a simple manner a high level of reliability and significant ease of operation. The tube and/or tamping pick tube which is arranged between the vibration decoupling device and a free end of the vibratory tamping machine has a length L. The tamping pick tube may be configured in one piece or in multiple pieces. The tamping pick tube has an upper portion and a lower portion. The upper portion has a length $L_o$, wherein the following applies: $L_o \leq 0.7$ L, in particular $L_o \leq 0.5$ L, and in particular $L_o \leq 0.3$ L. By the arrangement of the electric drive motor in the upper portion and outside the lower portion, the undamped mass of the vibratory tamping machine is high in the region of the lower portion. As a result, the vibratory tamping machine permits an efficient operation by means of the vibration mechanism. Accordingly, the electric drive motor is arranged relatively close to the decoupling plane and an end of the tamping pick tube connected to the vibration decoupling device, so that the maintenance and optionally the cooling of the electric drive motor are possible in a simple manner.

A vibratory tamping machine, in which the electric drive motor is arranged in a lower portion of a tube facing the ballast bed, ensures a simple construction and significant ease of operation. The tube and/or tamping pick tube which is arranged between the vibration decoupling device and a free end of the vibratory tamping machine has a length L. The tamping pick tube may be configured in one piece or in multiple pieces. The tamping pick tube has an upper portion and a lower portion. The lower portion has a length Lu, wherein the following applies: $L_u \leq 0.3$ L, in particular $L_u \leq 0.5$ L, and in particular $L_u \leq 0.7$ L. As the electric drive motor and the vibration mechanism are arranged in the lower portion, the mechanical construction is simple. An additional drive shaft between the vibration mechanism and the electric drive motor is not required.

Further features, advantages and details of the invention are disclosed in the following description of a plurality of exemplary embodiments.

DESCRIPTION OF THE PREFERRED EMBODIMENTS

Figure 1:
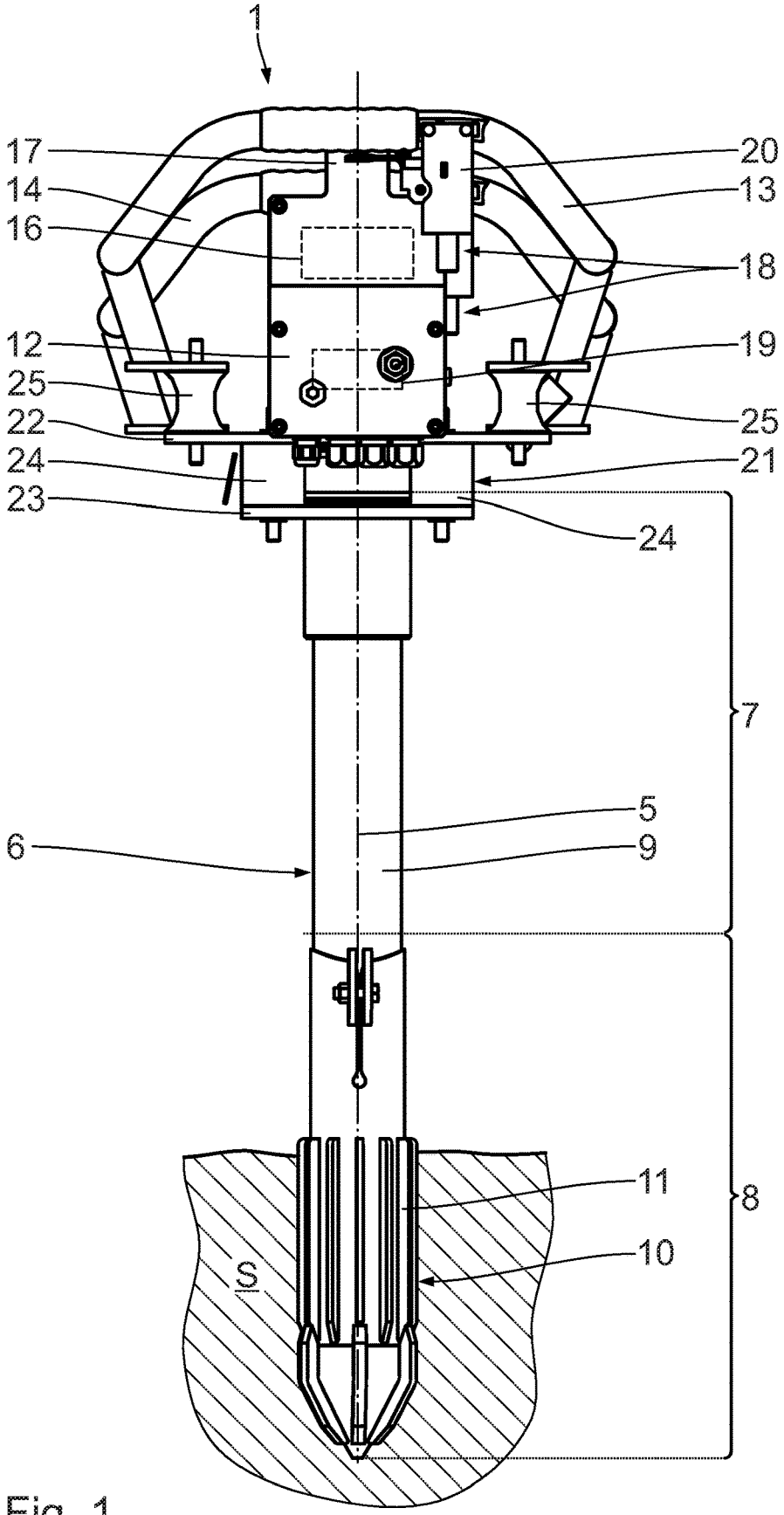
FIG. 1 shows a view of a vibratory tamping machine according to a first exemplary embodiment.
Figure 2:
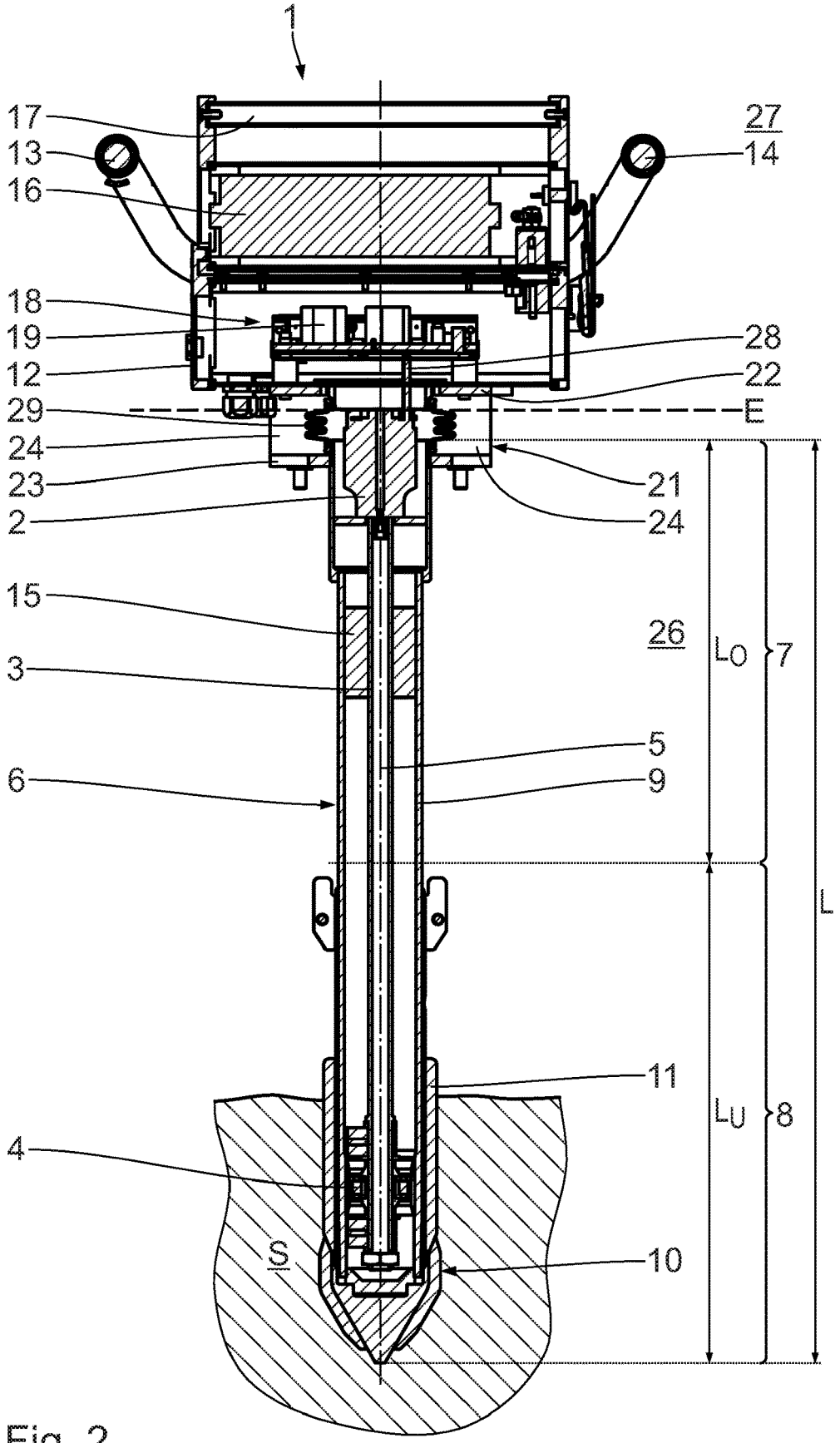
FIG. 2 shows a sectional view of the vibratory tamping machine in FIG. 1

A first exemplary embodiment of the invention is described hereinafter with reference to FIGS. 1 and 2. A vibratory tamping machine 1 which may be electrically operated has an electric drive motor 2 which is connected via a drive shaft 3 to a vibration mechanism 4. The vibration mechanism 4 comprises, for example, an unbalance which vibrates exclusively radially to a rotational axis 5 of the drive motor 2. The vibration mechanism 4 is known and conventional.

The electric drive motor 2, the drive shaft 3 and the vibration mechanism 4 are arranged in a tube and/or tamping pick tube 6. The tamping pick tube 6 has an axial length L and is subdivided into an upper portion 7 and a lower portion 8. The upper portion 7 has an axial length $L_o$, whereas the lower portion 8 has an axial length $L_u$. For the length $L_o$, the following preferably applies: $L_o \leq 0.7$ L, in particular $L_o \leq 0.5$ L, and in particular $L_o \leq 0.3$ L. Accordingly, for the length $L_u$, the following applies: $L_u \leq 0.3$ L, in particular $L_u \leq 0.5$ L, and in particular $L_u \leq 0.7$ L.

The tamping pick tube 6 comprises a tubular base body 9, a tamping tool 10 being replaceably fastened thereto. The tamping tool 10 has, for example, a plurality of tamping plates 11 which are distributed over the periphery and which extend radially.

The electric drive motor 2 is arranged at an end of the tamping pick tube 6 remote from the tamping tool 10 in the upper portion 7 and outside the lower portion 8. Accordingly, the vibration mechanism 4 is arranged in the vicinity of the tamping tool 10 in the lower portion 8 and outside the upper portion 7. The drive shaft 3 is mounted by means of a bearing 15 in the tamping pick tube 6.

The vibratory tamping machine 1 also comprises a support frame 12, a first handle 13 and a second handle 14 being arranged thereon at the side. A rechargeable battery 16 is replaceably fastened to the support frame 12.

The rechargeable battery 16 is connected to a third handle 17. The rechargeable battery 16 supplies the electric drive motor 2 and a control device 18 with electric power. The control device 18 comprises a controller 19 which is fastened to the support frame 12, and an operating unit 20 which is arranged on the handles 13, 14. The operating unit 20 has, for example, at least one operating element for activating the electric drive motor 2.

The vibratory tamping machine 1 has a vibration decoupling device 21 for the vibration-decoupling of the handles 13, 14, 17 from the vibration mechanism 4 and the electric drive motor 2. The vibration decoupling device 21 comprises a fastening element 22 on the operator side, which is fastened to the support frame 12, and fastening elements 23 on the working side, which are fastened to the tamping pick tube 6. The vibration decoupling device 21 further comprises a plurality of first vibration dampers 24 which connect the fastening element 22 on the operator side to the fastening elements 23 on the working side. By way of example, the vibratory tamping machine 1 has four vibration dampers 24 which are arranged about the rotational axis 5 of the electric drive motor 2. Moreover, the vibration decoupling device 21 comprises a plurality of second vibration dampers 25 which connect the handles 13, 14 to the fastening element 22 on the operator side and to the support frame 12. The vibration dampers 24, 25 are produced from an elastomer material, for example from a rubber material.

The vibration decoupling device 21 and/or the vibration dampers 24 form a decoupling plane E which decouples a working side 26 from an operating side 27. The tamping pick tube 6, the electric drive motor 2, the drive shaft 3 and the vibration mechanism 4 are arranged on the working side 26. Accordingly, the support frame 12 with the handles 13, 14 and the rechargeable battery 16 with the handle 17 and the control device 18 are arranged on the operating side 27.

Electrical lines 28 for controlling and supplying power to the electric drive motor 2 run exclusively through the decoupling plane E from the operating side 27 to the working side 26. The electrical lines 28 are illustrated merely schematically in FIG. 2. The electrical lines 28 are protected by a rubber bellows 29.

The vibratory tamping machine 1 serves for compacting a ballast bed S of a track, in particular below sleepers of the track. By means of the control device 18 the electric drive motor 2 is activated by an operator such that the ballast bed S is compacted in the desired manner by means of the tamping tool 10 located in the ballast bed S. In this case, the operator holds the vibratory tamping machine 1 in both hands, for example on the handles 13 and 14. Forces and/or vibrations generated by the electric drive motor 2 and the vibration mechanism 4 are effectively damped by the vibration decoupling device 21 so that the working side 26 is vibration-decoupled from the operating side 27. The rechargeable battery 16 in this case acts on the operating side 27 as a counterweight and produces an effective vibration damping.

If the rechargeable battery 16 is discharged, it may be exchanged in a simple manner by means of the handle 17 and replaced by a charged rechargeable battery 16. As the control device 18 is arranged on the operating side 27, it is protected from vibrations.

Figure 3:
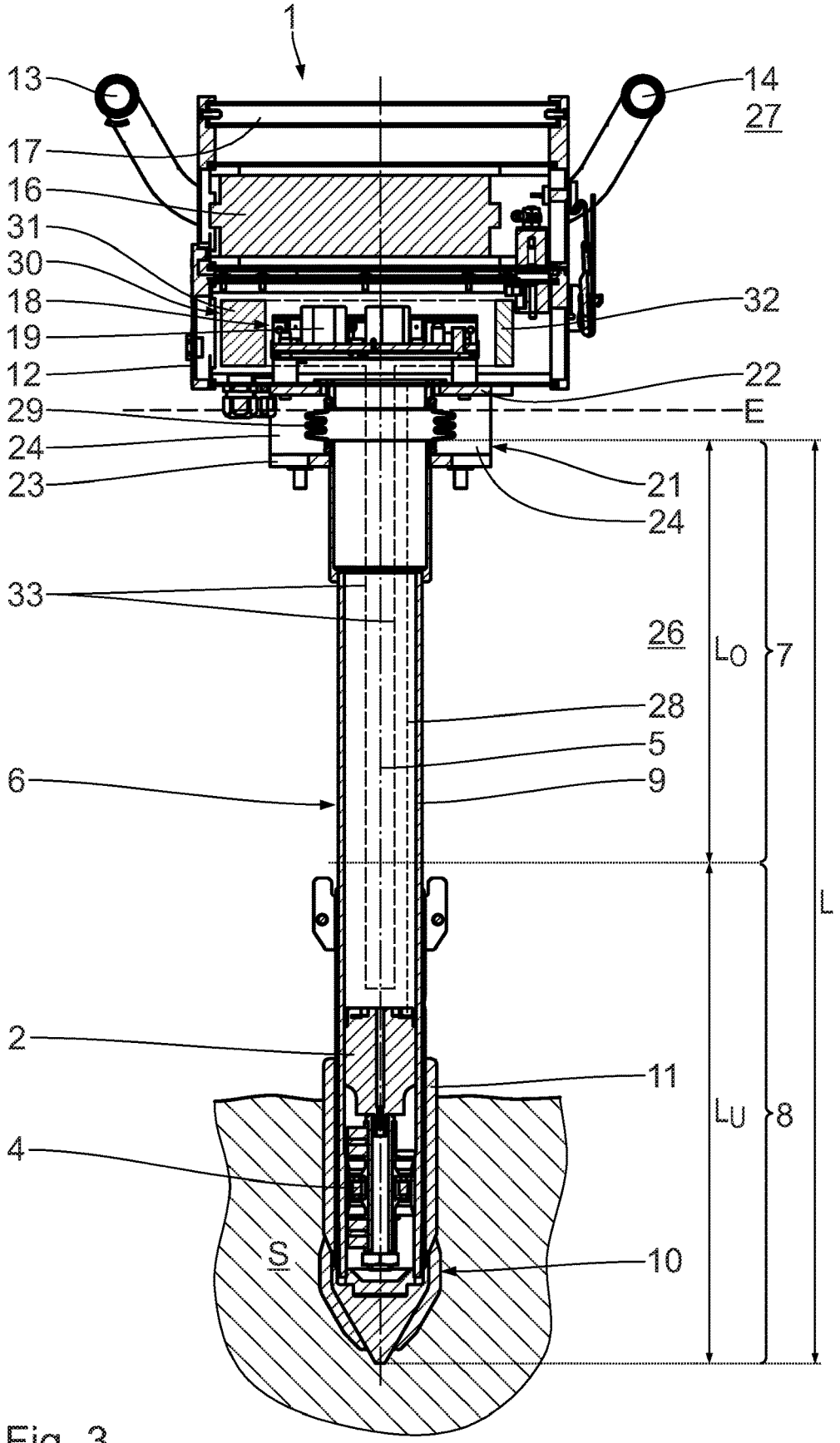
FIG. 3 shows a sectional view of a vibratory tamping machine according to a second exemplary embodiment.

A second exemplary embodiment of the invention is described hereinafter with reference to FIG. 3. In contrast to the above exemplary embodiment, the electric drive motor 2 is arranged in the lower portion 8, i.e. outside the upper portion 7, of the tamping pick tube 6. The electric drive motor 2 is connected directly to the vibration mechanism 4, so that an additional drive shaft and an associated bearing are not required. The vibratory tamping machine 1 further comprises a cooling device 30 with a cooler 31, a pump 32 and a coolant line 33. The cooler 31 and the pump 32 are arranged on the support frame 12 on the operating side 27. The coolant line 33 leads from the cooler 31 and the pump 32 through the decoupling plane E into the tamping pick tube 6 and to the drive motor 2 and the vibration mechanism 4. By means of the pump 32, a coolant is pumped through the coolant line 33 so that heat generated by the drive motor 2 and the vibration mechanism 4 is dissipated from the tamping pick tube 6 and conveyed to the cooler 31. By means of the cooler 31, the heat supplied to the coolant is dissipated back into the surroundings. Regarding the further construction and the further mode of operation of the vibratory tamping machine 1, reference is made to the above exemplary embodiment.

The invention claimed is:

1. A vibratory tamping machine for compacting a ballast bed of a track, the vibratory tamping machine comprising:

a vibration mechanism;

an electric drive motor for driving the vibration mechanism;

a support frame;

at least one handle for holding the vibratory tamping machine; and a vibration decoupling device for the vibration-decoupling of the at least one handle and the vibration mechanism, wherein the vibration decoupling device defines a decoupling plane which separates a working side from an operating side, wherein the vibration mechanism and the electric drive motor are arranged on the working side, wherein the at least one handle and a rechargeable battery for supplying the electric drive motor with electric power are arranged on the operating side, wherein the at least one handle, the rechargeable battery and the vibration decoupling device are fastened to the support frame, wherein an axis of rotation of the electric drive motor intersects the rechargeable battery.

2. The vibratory tamping machine according to claim 1, wherein the vibration decoupling device comprises at least one vibration damper for forming the decoupling plane between the vibration mechanism and the at least one handle.

3. The vibratory tamping machine according to claim 1, wherein the rechargeable battery is replaceably fastened to the support frame and is connected to a handle.

4. The vibratory tamping machine according to claim 1, wherein a control device is arranged on the operating side.

5. The vibratory tamping machine according to claim 1, wherein electrical lines for activating and supplying electric power to the electric drive motor run through the decoupling plane, wherein no mechanical drive shaft extends through the decoupling plane.

6. The vibratory tamping machine according to claim 1, further comprising a cooling device configured for cooling at least one of the electric drive motor and the vibration mechanism.

7. The vibratory tamping machine according to claim 1, wherein the electric drive motor is arranged in an upper portion of a tube facing the decoupling plane.

8. The vibratory tamping machine according to claim 1, wherein the electric drive motor is arranged in a lower portion of a tube facing the ballast bed.

9. The vibratory tamping machine according to claim 1, wherein no mechanical connection for driving the vibration mechanism runs through the decoupling plane.

10. The vibratory tamping machine according to claim 1, wherein the vibration decoupling device comprises at least one vibration damper, the at least one vibration damper defining at least a portion of the decoupling plane.

11. The vibratory tamping machine according to claim 10, wherein the rechargeable battery is located between a portion of the handle and the at least one vibration damper.

12. The vibratory tamping machine according to claim 10, wherein the at least one vibration damper and the support frame are located adjacent to a fastening element.

13. The vibratory tamping machine according to claim 12, wherein the vibration decoupling device comprises at least another vibration damper located on one side of the fastening element, the at least one vibration damper being located on another side of the fastening element.

14. The vibratory tamping machine according to claim 13, wherein the at least another vibration damper is in contact with the fastening element at a position located below the support frame.

15. A vibratory tamping machine for compacting a ballast bed of a track, the vibratory tamping machine comprising:

a vibration mechanism;

an electric drive motor for driving the vibration mechanism;

a handle for holding the vibratory tamping machine;

a support frame, at least a portion of the support frame being located adjacent to a portion of the handle;

a rechargeable battery configured to supply the electric drive motor with power, wherein an axis of rotation of the electric drive motor intersects the rechargeable battery; and a vibration decoupling device for the vibration-decoupling of the handle and the vibration mechanism, wherein the vibration decoupling device defines a decoupling plane separating a working side from an operating side, wherein the vibration mechanism and the electric drive motor are arranged on the working side, wherein the handle and the rechargeable battery are arranged on the operating side, wherein the handle, the rechargeable battery and the vibration decoupling device are fastened to the support frame.

16. The vibratory tamping machine according to claim 15, further comprising a fastening element, at least another portion of the support frame being located adjacent to the fastening element.

17. The vibratory tamping machine according to claim 15, wherein the vibration decoupling device comprises at least one vibration damper, the at least one vibration damper defining the decoupling plane.

18. The vibratory tamping machine according to claim 15, wherein the rechargeable battery is located between a portion of the handle and the at least one vibration damper.

19. The vibratory tamping machine according to claim 16, wherein the vibration decoupling device comprises at least another vibration damper located on one side of the fastening element, the at least one vibration damper being located on another side of the fastening element.

20. The vibratory tamping machine according to claim 19, wherein the at least another vibration damper is in contact with the fastening element at a position located below the support frame.

* * * * *